US007568612B2

(12) United States Patent
Ho Fung et al.

(10) Patent No.: US 7,568,612 B2
(45) Date of Patent: Aug. 4, 2009

(54) CARTON WITH DISPENSER

(75) Inventors: Charles F. Ho Fung, Dunwoody, GA (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 205 days.

(21) Appl. No.: 11/696,487

(22) Filed: Apr. 4, 2007

(65) Prior Publication Data

US 2007/0228133 A1 Oct. 4, 2007

Related U.S. Application Data

(60) Provisional application No. 60/789,008, filed on Apr. 4, 2006.

(51) Int. Cl.
*B65D 17/28* (2006.01)

(52) U.S. Cl. ..... 229/242; 206/427; 229/122

(58) Field of Classification Search ..... 229/122, 229/240, 242; 221/302, 305; 206/427
See application file for complete search history.

(56) References Cited

U.S. PATENT DOCUMENTS

| | | | | |
|---|---|---|---|---|
| 1,925,102 | A | 9/1933 | Levkoff | |
| 2,072,695 | A | 3/1937 | Wellman | |
| 2,115,673 | A | 4/1938 | Stompe | |
| 2,299,027 | A | 10/1942 | Novak | |
| 3,178,242 | A | 4/1965 | Ellis et al. | |
| 3,228,582 | A | 1/1966 | Osberg | |
| 3,265,283 | A | 8/1966 | Farquhar | |
| 3,356,279 | A | 12/1967 | Root | |
| 3,533,549 | A | 10/1970 | Gilchrist | |
| 3,540,581 | A | 11/1970 | Koolnis | |
| 3,599,858 | A * | 8/1971 | Samsing | 229/122 |
| 3,829,006 | A | 8/1974 | Spiegel | |
| 4,378,877 | A | 4/1983 | Botterman et al. | |
| 4,382,511 | A | 5/1983 | Hamelin et al. | |
| 4,396,143 | A | 8/1983 | Killy | |
| 4,417,655 | A | 11/1983 | Forbes, Jr. | |
| 4,577,762 | A | 3/1986 | Kuchenbecker | |
| 4,605,128 | A | 8/1986 | Rieke | |
| 4,890,440 | A | 1/1990 | Romagnoli | |
| 4,949,845 | A | 8/1990 | Dixon | |
| 4,974,771 | A | 12/1990 | Lavery | |
| 5,060,792 | A | 10/1991 | Oliff | |
| 5,137,211 | A | 8/1992 | Summer et al. | |
| 5,219,229 | A | 6/1993 | Sengewald | |
| 5,482,185 | A | 1/1996 | McNaughton | |
| 5,505,372 | A | 4/1996 | Edson et al. | |
| 5,577,612 | A | 11/1996 | Chesson et al. | |
| 5,622,309 | A | 4/1997 | Matsuda et al. | |
| 5,655,705 | A | 8/1997 | Bates | |
| 5,664,683 | A | 9/1997 | Brody | |
| 5,690,213 | A | 11/1997 | Matsumura | |

(Continued)

FOREIGN PATENT DOCUMENTS

| | | | |
|---|---|---|---|
| CA | 873185 | A1 | 6/1971 |

(Continued)

*Primary Examiner*—Gary E Elkins
(74) *Attorney, Agent, or Firm*—Womble Carlyle Sandridge & Rice, PLLC

(57) ABSTRACT

A carton having a dispenser with a removable dispenser panel. The dispenser panel is configured to be easily removed and to allow access to containers in the carton.

29 Claims, 7 Drawing Sheets

U.S. PATENT DOCUMENTS

| | | | | |
|---|---|---|---|---|
| 5,826,783 | A | 10/1998 | Stout | |
| 5,875,961 | A | 3/1999 | Stone et al. | |
| 5,881,884 | A | 3/1999 | Podosek | |
| 5,921,398 | A | 7/1999 | Carroll | |
| 5,924,559 | A | 7/1999 | Carrel et al. | |
| 6,176,419 | B1 | 1/2001 | Holley, Jr. | |
| 6,283,293 | B1 | 9/2001 | Lingamfelter | |
| 6,386,369 | B2 | 5/2002 | Yuhas et al. | |
| 6,409,077 | B1 | 6/2002 | Telesca et al. | |
| D459,927 | S | 7/2002 | Flowers et al. | |
| 6,484,903 | B2 | 11/2002 | Spivey et al. | |
| 6,550,615 | B2 | 4/2003 | Lingamfelter | |
| 6,557,699 | B1 | 5/2003 | Focke et al. | |
| 6,578,736 | B2 | 6/2003 | Spivey | |
| 6,604,677 | B1 | 8/2003 | Sutherland et al. | |
| 6,669,083 | B2 | 12/2003 | Bates | |
| 6,715,639 | B2 | 4/2004 | Spivey | |
| 6,752,262 | B1 | 6/2004 | Boriani et al. | |
| 6,789,673 | B2 | 9/2004 | Lingamfelter | |
| 6,866,185 | B2 | 3/2005 | Harrelson | |
| 6,866,186 | B2 | 3/2005 | Fogle et al. | |
| 6,869,009 | B2 | 3/2005 | Sutherland et al. | |
| 6,902,104 | B2 | 6/2005 | Holley, Jr. et al. | |
| 6,918,487 | B2 | 7/2005 | Harrelson | |
| 6,929,172 | B2 | 8/2005 | Bates et al. | |
| 6,991,107 | B2 | 1/2006 | Harrelson | |
| 6,997,316 | B2 | 2/2006 | Sutherland | |
| 7,104,435 | B2 | 9/2006 | Holley, Jr. | |
| 7,225,930 | B2 | 6/2007 | Ford et al. | |
| 7,273,161 | B2 * | 9/2007 | Fogle et al. | 229/242 |
| 7,296,731 | B2 | 11/2007 | Auclair et al. | |
| 7,374,043 | B2 * | 5/2008 | Holley et al. | 206/427 |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2003/0234285 | A1 | 12/2003 | Bates et al. | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0154945 | A1 | 8/2004 | Harrelson | |
| 2004/0155098 | A1 | 8/2004 | Harrelson | |
| 2004/0159671 | A1 | 8/2004 | Spivey | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0189405 | A1 | 9/2005 | Gomes et al. | |
| 2006/0091191 | A1 | 5/2006 | DeBusk | |
| 2006/0118606 | A1 | 6/2006 | Holley, Jr. et al. | |
| 2006/0175386 | A1 | 8/2006 | Holley, Jr. | |
| 2006/0261140 | A1 * | 11/2006 | Holley | 229/242 |
| 2007/0063003 | A1 | 3/2007 | Spivey et al. | |
| 2007/0114151 | A1 * | 5/2007 | Auclair | 206/427 |
| 2007/0164093 | A1 * | 7/2007 | Spivey et al. | 229/122 |
| 2007/0228133 | A1 | 10/2007 | Ho Fung et al. | |

FOREIGN PATENT DOCUMENTS

| | | | |
|---|---|---|---|
| EP | 0 066 029 | A1 | 12/1992 |
| EP | 1 279 618 | A1 | 1/2003 |
| FR | 2 549 010 | | 1/1985 |
| GB | 2 264 101 | A | 8/1993 |
| GB | 2 300 853 | A | 11/1996 |
| WO | WO 96/29260 | | 9/1996 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | A1 | 6/2005 |
| WO | WO 2005/051782 | A1 | 6/2005 |
| WO | WO 2006/050210 | A2 | 5/2006 |
| WO | WO 2006/050316 | A1 | 5/2006 |
| WO | WO 2006/052537 | A1 | 5/2006 |

* cited by examiner

CARTON WITH DISPENSER

CROSS-REFERENCE TO RELATED APPLICATION

This application claims the benefit of U.S. Provisional Application No. 60/789,008 which was filed on Apr. 4, 2006. The entire content of the above-referenced provisional application is hereby incorporated by reference as if presented herein in its entirety.

BACKGROUND OF INVENTION

The present invention generally relates to cartons for holding and dispensing cylindrical containers or other types of articles.

Enclosed cartons with dispensing features have been used in the past. Many of these cartons create a dispenser opening by providing a removable dispenser panel demarcated by tear lines or the like that are formed into a dispenser when a carton blank is formed into a carton. The dispenser panel is removable from, or hingedly attached to, the carton to create an opening from which articles can be removed from the carton. Typically, the dispenser panel may be difficult to remove from the carton and may require considerable manipulation and force from the user. It is desired to provide a carton with a dispenser panel that can be quickly and easily removed from the carton to form the opening for dispensing articles.

SUMMARY OF THE INVENTION

In general, one aspect of the invention is generally directed to a carton comprising a carton for containing a plurality of articles. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels. The end flaps are overlapped with respect to one another and thereby at least partially close an end of the carton. A dispenser is for allowing removal of articles from the carton. The dispenser comprises a dispenser panel that is at least partially defined by a tear line in the carton and is for being at least partially removed for at least further opening a dispenser opening. The dispenser panel comprises an access flap in the top panel for initiating removal of the dispenser panel. In the top panel, the tear line comprises a first oblique portion extending from the access flap to proximate a first edge of the top panel and a second oblique portion extending from the access flap to proximate a second edge of the top panel.

In another aspect, the invention is generally directed to a blank for forming a carton. The blank comprises a plurality of panels. The plurality of panels comprises a top panel, a bottom panel, a first side panel, and a second side panel. At least two end flaps are respectively foldably attached to respective panels of the plurality of panels. Dispenser features comprise at least one dispenser panel that is at least partially defined by a tear line for at least partially separating the dispenser panel from the blank. The dispenser panel comprises an access flap in the top panel. In the top panel, the tear line comprises a first oblique portion extending from the access flap to proximate a first edge of the top panel and a second oblique portion extending from the access flap to proximate a second edge of the top panel.

In another aspect, the invention is generally directed to a method of opening a carton. The method comprises providing a carton having a plurality of panels that extends at least partially around an interior of the carton. The plurality of panels comprises a top panel, a bottom panel, a first side panel, a second side panel, and end flaps respectively foldably attached to respective panels of the plurality of panels. The end flaps are overlapped with respect to one another and thereby at least partially form a closed end of the carton. A dispenser comprises a dispenser panel at least partially defined by a tear line in the carton and comprises an access flap in the top panel. The tear line comprises a first oblique portion extending from the access flap to proximate a first edge of the top panel and a second oblique portion extending from the access flap to proximate a second edge of the top panel. The method further comprises folding the access flap to allow access to the dispenser panel and grasping the dispenser panel and at least partially separating the dispenser panel from the carton by at least partially tearing the carton along the first and second oblique portions to create a dispenser opening in the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE ILLUSTRATED EMBODIMENT

The present invention generally relates to a dispenser for a carton. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the invention, the following detailed description describes generally cylindrical beverage containers as disposed within the carton embodiments. In this specification, the terms "lower," "bottom," "upper" and "top" indicate orientations determined in relation to fully erected cartons.

Figure 1:
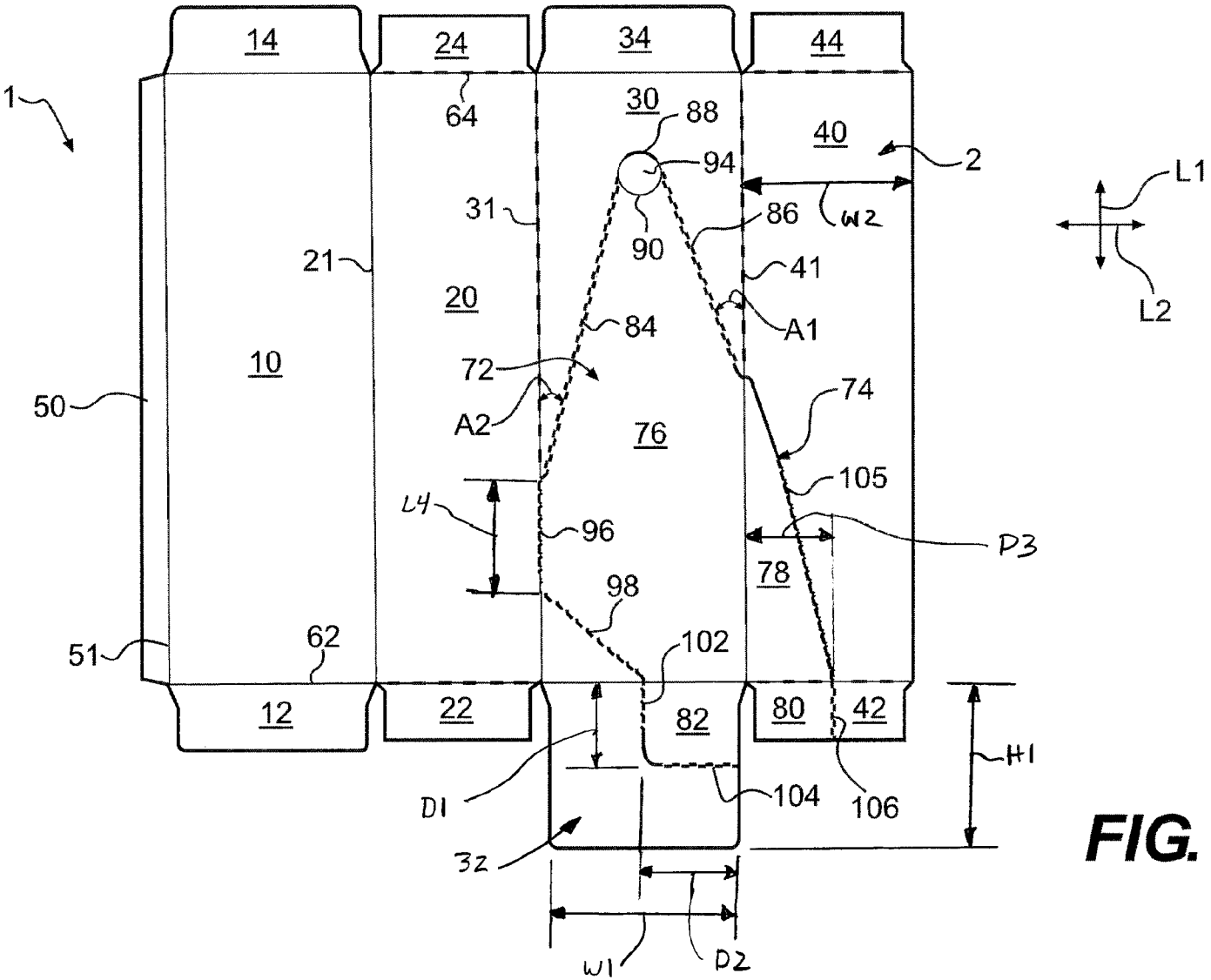
FIG. 1 is a plan view of a blank used to form a carton according to one embodiment of the invention.
Figure 7:
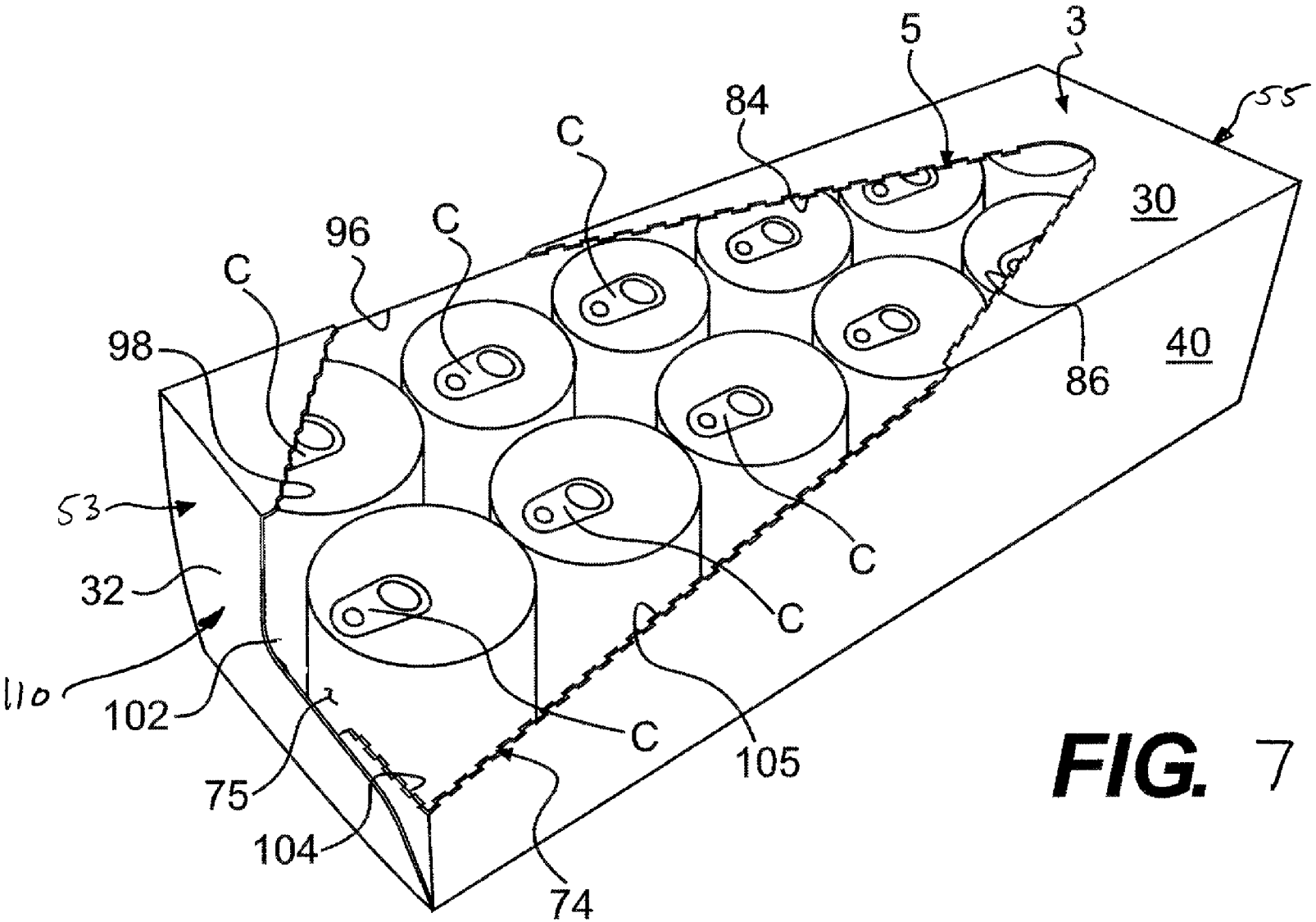
FIG. 7 is a perspective of the carton with the dispenser opened.

FIG. 1 is a plan view of the exterior side 2 of a blank, generally indicated at 1, used to form a carton 3 (FIG. 2) according to the illustrated embodiment of the invention. The carton 3 can be used to house a plurality of articles such as containers C (FIG. 7). The carton 3 has a dispenser 5, formed from various dispenser features in the blank 1, for allowing access to the containers C. In the illustrated embodiment, the containers C are arranged in a single layer in a 2×6 arrangement, but it is understood that the carton 3 may be sized and shaped to hold containers C of a different or same quantity in more than one layer and/or in different row/column arrangements (e.g., 2×6, 3×6, 4×3, 2×6×2, 3×4×2, etc.)

The blank 1 has a longitudinal axis L1 and a lateral axis L2. In the illustrated embodiment, the blank 1 comprises a bottom panel 10 foldably connected to a first side panel 20 at a first longitudinal fold line 21, a top panel 30 foldably connected to the first side panel 20 at a second longitudinal fold line 31, and a second side panel 40 foldably connected to the top panel 30 at a third longitudinal fold line 41. In the illustrated embodiment, an adhesive flap 50 is foldably connected to the bottom panel 10 at a fourth longitudinal fold line 51.

The bottom panel 10 is foldably connected to a first bottom end flap 12 and a second bottom end flap 14. The first side panel 20 is foldably connected to a first side flap 22 and a second side flap 24. The top panel 30 is foldably connected to a first top end flap 32 and a second top end flap 34. The second side panel 40 is foldably connected to a first side flap 42 and a second side flap 44. When the carton 3 is erected, the end flaps 12 and 32 and side flaps 22 and 42 close one end 53 of the carton, and the end flaps 14 and 34 and side flaps 24 and 44 close a second end 55 of the carton. In accordance with an alternative embodiment of the present invention, different flap arrangements can be used for closing the ends of the carton.

The end flaps 12 and 32 and side flaps 22 and 42 may extend along a first marginal area of the blank 1, and may be foldably connected at a first lateral fold line 62 that extends along the width of the blank. The end flaps 14 and 34 and side flaps 24 and 44 may extend along a second marginal area of the blank 1, and may be foldably connected at a second lateral fold line 64 that also extends along the width of the blank. The lateral fold lines 62, 64 may be, for example, substantially straight, or offset at one or more locations to account for blank thickness or for other factors.

The dispenser 5 includes a dispenser panel, generally indicated at 72, removably attached to the blank 1 at a tear line, generally indicated at 74. As shown in FIG. 7, the dispenser 5 includes an opening 75 in the carton 3 to allow containers C to be removed from the carton. In the illustrated embodiment, the dispenser panel 72 includes a first portion 76 in the top panel 30 of the blank 1, a second portion 78 in the side panel 40, a third portion 80 in the first side flap 42, and a fourth portion 82 in the first end flap 32. The tear line 74 includes a first portion 84 and a second portion 86 comprising respective oblique tear lines in the top panel 30 that converge and meet at a rounded corner 88 of the tear line. The dispenser 5 includes a curved fold line 90 radially opposed with the rounded corner 88 and cooperating with the rounded corner to form a generally round finger flap 94 (broadly "access flap") in the top panel 30 of the carton 3. In the illustrated embodiment, the finger flap 94 is generally circular-shaped with the fold line 90 forming one circumferential portion of the circular-shaped finger panel (e.g., the bottom portion as viewed in FIG. 1) and the rounded corner 88 forming the other circumferential portion of the circular-shaped finger panel (e.g., the top portion as viewed in FIG. 1). The first portion 84 of the tear line 76 extends obliquely from the rounded corner 88 to proximate the edge of the top panel 30 defined by the longitudinal fold line 31, and the second portion 86 extends obliquely from the rounded corner to proximate the edge of the top panel defined by the longitudinal fold line 41. The first portion 84 and second portion 86 of the tear line 76 may extend to and intersect with a respective fold line 31, 41 or the first and second portion may extend to a location adjacent and proximate the respective fold line without departing from the invention. In the illustrated embodiment, the second portion 86 of the tear line 76 is positioned at an oblique angle A1 relative to the longitudinal fold line 41, and the first portion 84 is positioned at an oblique angle A2 relative to the longitudinal fold line 31. The angle A1 is greater than the angle A2 so that the second portion 86 of the tear line 74 intersects the fold line 41 at a location that is spaced in the longitudinal direction closer to the finger flap 94 than the intersection of the first portion 84 of the tear line with the fold line 31.

The tear line 74 includes a third portion 96 that connects to the first portion 84 and is generally coextensive with a portion of the edge of the top panel defined by the longitudinal fold line 31. A fourth portion 98 of the tear line 74 extends obliquely from the third portion across a portion of the top panel 30 to the lateral fold line 62. The tear line 74 includes a fifth portion 102 extending generally in the longitudinal direction from the intersection of the fourth portion 98 with the lateral fold line 62 into the end flap 32, and a sixth portion 104 that is perpendicular to the fifth portion and extends therefrom to an edge of the end flap 32. A seventh portion 105 of the tear line 74 extends from the intersection of the second portion 86 with the longitudinal fold line 41 obliquely into the side panel 40 and intersects the lateral fold line 62. An eighth portion 106 of the tear line 74 extends from the intersection of the seventh portion 105 with the lateral fold line 62 into the side flap 42 to an edge thereof.

In the illustrated embodiment, the tear line 74 is shaped to form an asymmetrical dispenser panel that comprises a portion of the top panel 30, side panel 40, end flap 32 and side flap 42. The first, second, third, and fourth portions 84, 86, 96, 98 of the tear line 74 cooperate with a portion of the longitudinal fold line 41 and a portion of the lateral fold line 62 to define the first portion 76 of the dispenser panel 72 that is in the top panel 30. The seventh portion 105 of the tear line 74, a portion of the longitudinal fold line 41, and a portion of the lateral fold line 62 define the second portion 78 of the dispenser panel that is in the side panel 40. The eight portion 106 of the tear line 74 and a portion of the lateral fold line 62 connecting the end flap 42 to the side panel 40 cooperate to define the third portion 80 of the dispenser panel 72 that is in the side end flap 42. The fifth and sixth portions 102, 104 of the tear line 74 and a portion of the lateral fold line 62 cooperate to define the fourth portion 82 of the dispenser panel 72 that is in the top end flap 32. It is understood that the dispenser panel 72 of the illustrated embodiment is asymmetrical in that the dispenser panel does not have an axis of symmetry. It is understood that the dispenser 5 of the present invention may be otherwise configured such that the dispenser may have at least one axis of symmetry without departing from the scope of this invention.

In accordance with the exemplary embodiment, the blank 1 can be erected into the carton 3 by folding along fold lines 21, 31, 41, 51 and adhering the adhesive flap 50 to the second side panel 40. The ends 53, 55 of the carton 3 can be closed by respectively overlapping and adhering the end flaps 12, 32, 14, 34 and side flaps 22, 42, 24, 44 after the containers C are inserted into the carton.

Figure 4:
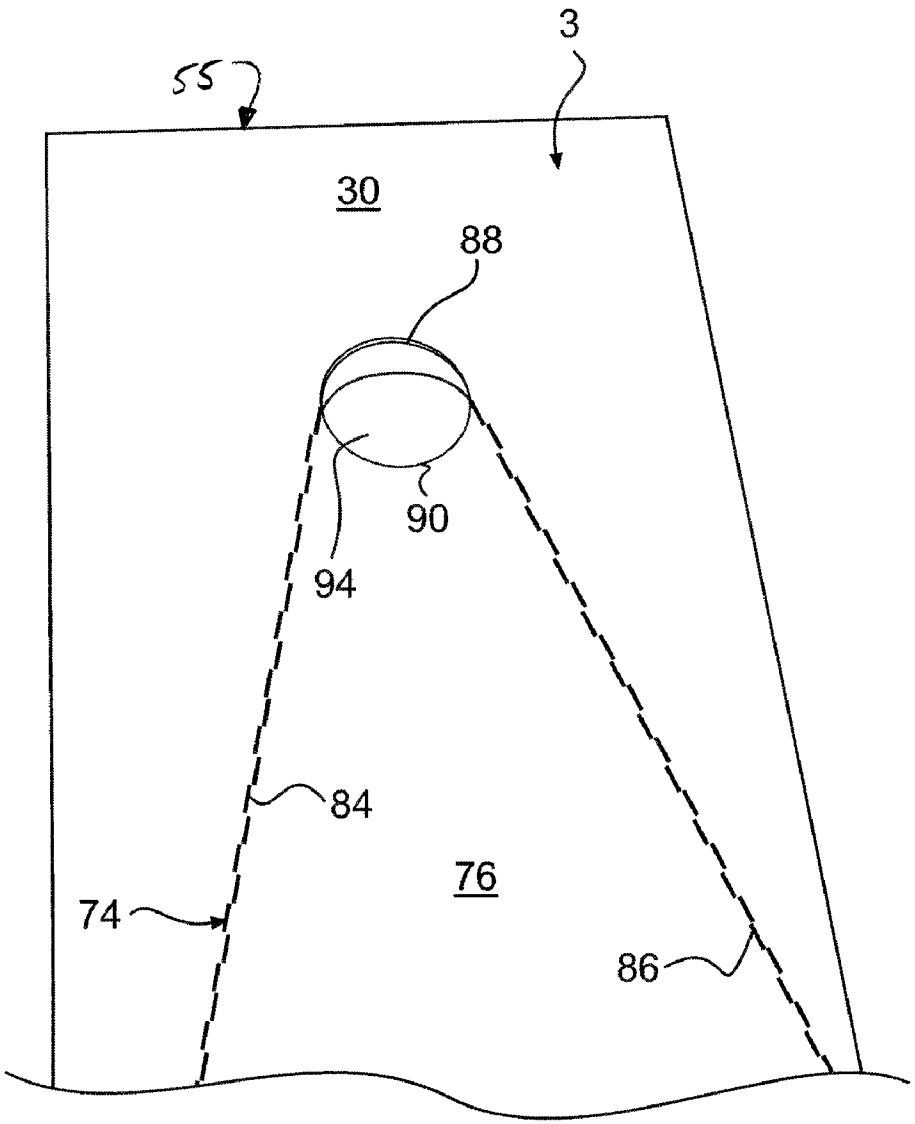
FIG. 4 is an enlarged view of the carton with an access flap engaged to begin opening of a dispenser.
Figure 5:
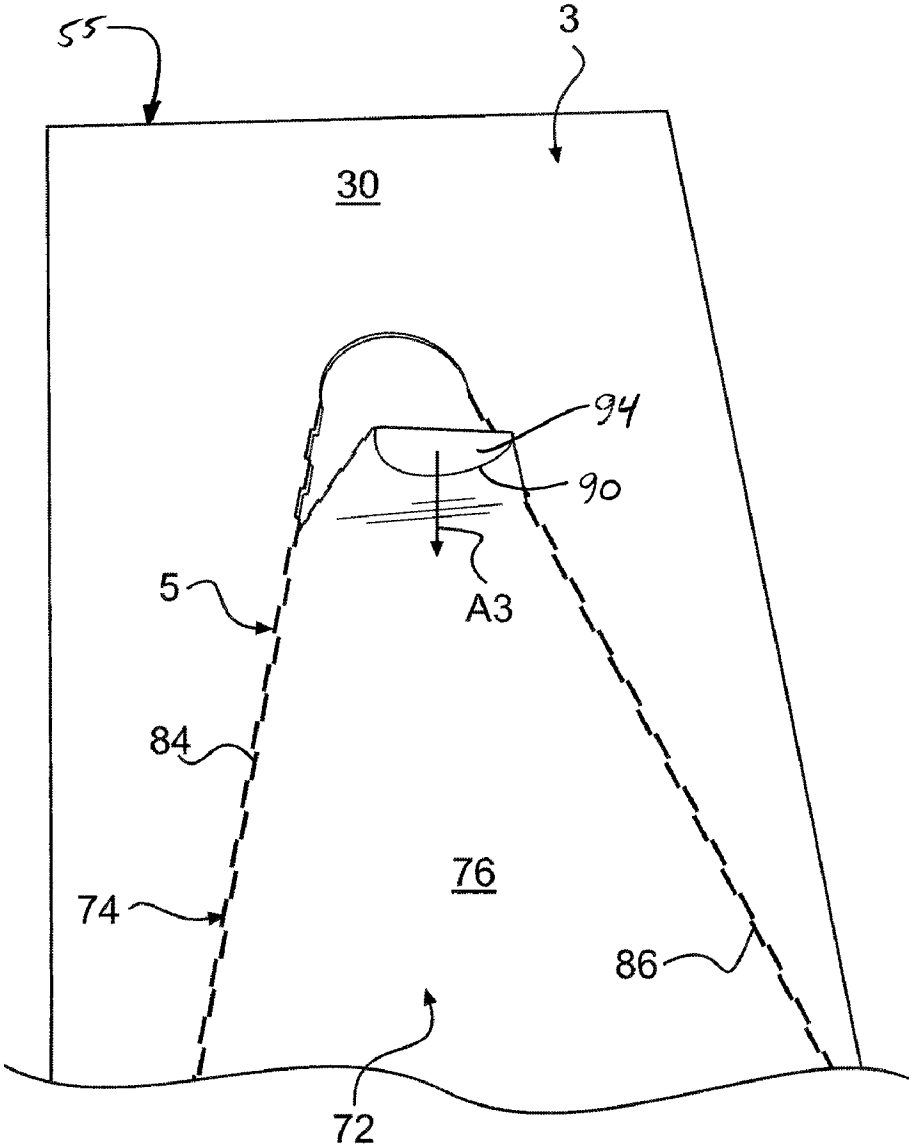
FIG. 5 is a view similar to FIG. 4 but showing the dispenser partially opened.
Figure 6:
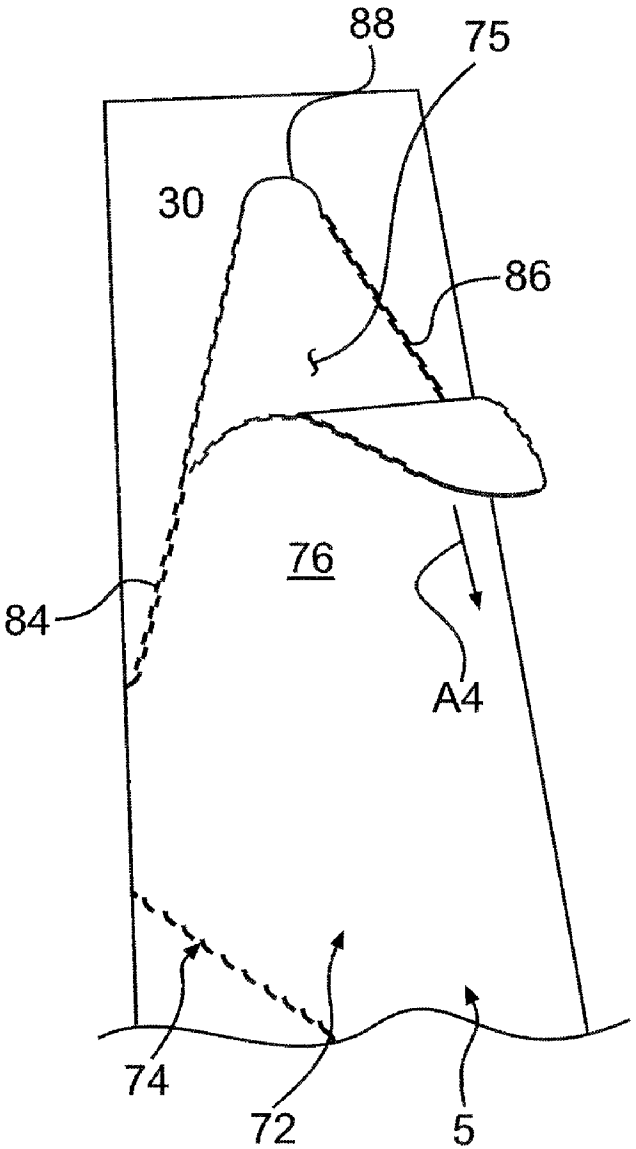
FIG. 6 is a view similar to FIG. 5 but showing the dispenser further partially opened.

As shown in FIGS. 4-7, the dispenser panel 72 may be removed from the carton 3 to form the dispenser opening 75. An exemplary opening process can begin with pressing against the finger flap 94 to tear the dispenser panel 72 along the rounded portion 88 of the tear line 74 and fold the finger panel inward along fold line 90 (FIG. 4). Once the finger flap 94 is folded inward, the first portion 76 of the dispenser panel 72 is grasped and pulled in the direction of arrow A3 (FIG. 5) to tear the carton 3 along the first and second portions 84, 86 of the tear line 74 to remove the dispenser panel from the carton. In the illustrated embodiment, the dispenser panel 72 and tear line 74 are shaped to facilitate removal of the dispenser panel by a right-handed user. In one embodiment, the second portion 86 of the tear line 74 is completely separated from the top panel 30 prior to complete separation of the first portion 84 so that the seventh portion 105 of the tear line begins to tear in the side panel 40 while the first portion is partially attached. In this way the natural motion of the user removing the dispenser panel starts out in the direction of arrow A3 generally parallel to the longitudinal axis L1, but changes to the direction of arrow A4 (FIG. 6) that is generally oblique to the longitudinal axis and lateral axis L2 as the dispenser panel is removed.

It is understood that the dispenser panel 72 and tear line 74 may be otherwise sized and shaped to correspond with various other sizes and shapes of containers C which may be housed in the carton 3. Further, the carton 150 can be erected after turning over the blank 1 (so that the "exterior side" 2 of the blank ends up being interior) so that the dispenser panel 72 is arranged for a left-handed user. In addition, the dispenser panel 72 and tear line 74 may be alternatively configured so that the dispenser panel 72 is shaped for a left-handed user in that the dispenser panel may include a portion of the side panel 20. Alternatively, the dispenser panel 72 may be shaped to include a portion of both side panels 20, 30 or may be shaped to include only a portion of the top panel 30 without departing from the scope of this invention.

Figure 2:
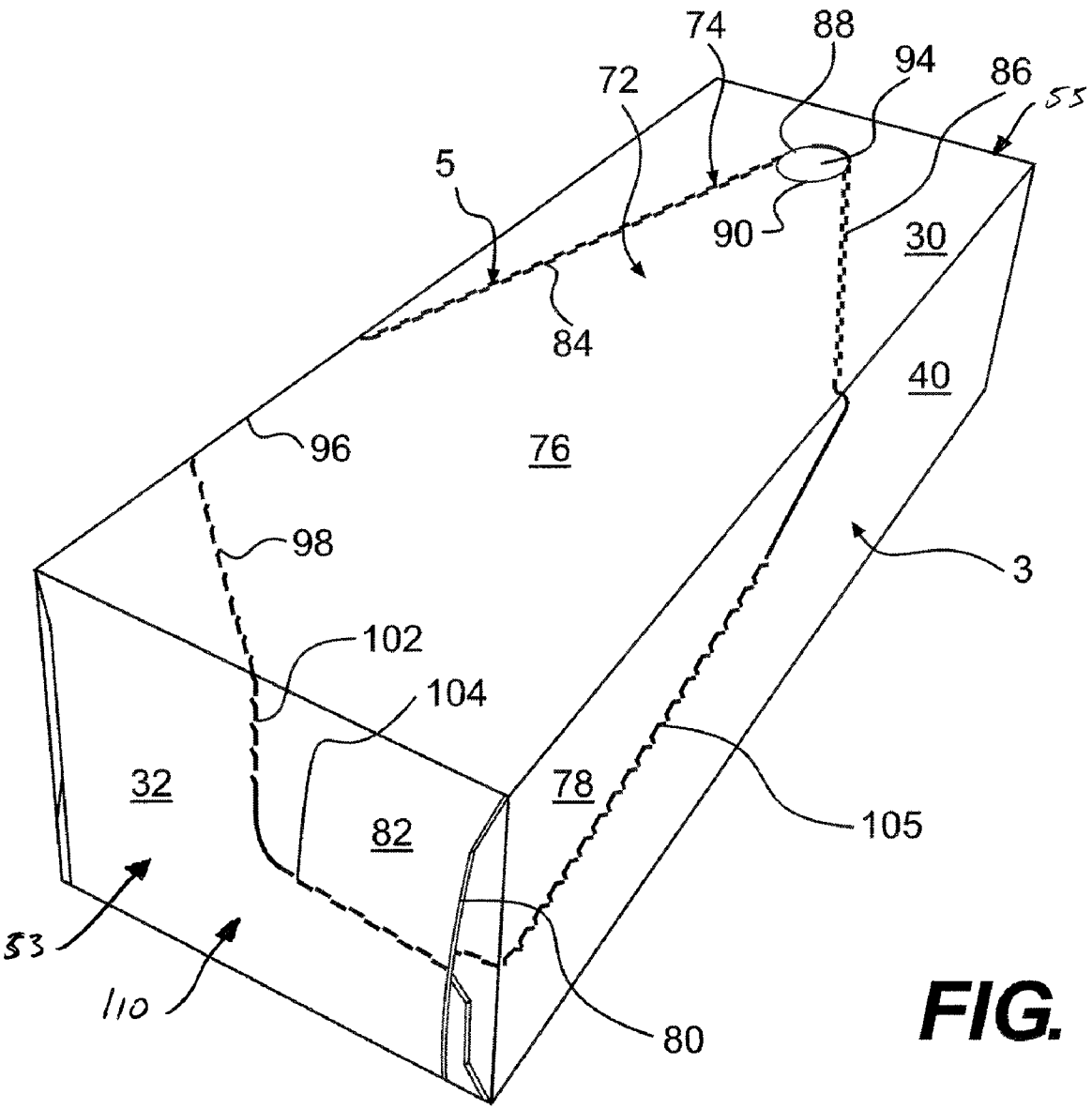
FIG. 2 is a front perspective of the carton.
Figure 3:
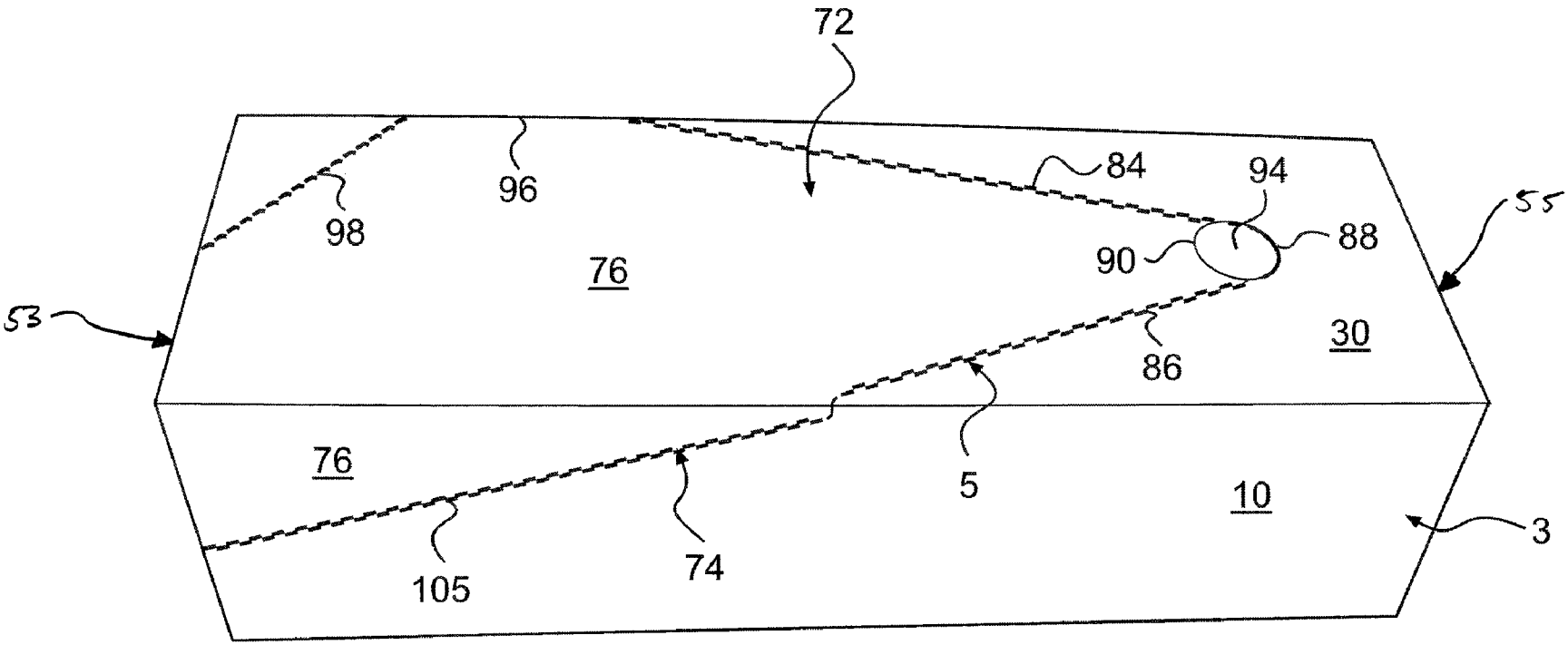
FIG. 3 is a side perspective of the carton.

As shown in FIG. 7, once the dispenser panel 72 is removed from the carton 3, the containers C may be removed from the opening 75. In the illustrated embodiment, the opening 75 includes portions of the top panel 30, side panel 40, end flap 32 and side flap 42. As shown in FIGS. 1 and 2, the end flap 32 of the top panel 30 is sized to overlap the end flap 12 of the bottom panel 10. The overlapping configuration of the end flaps 32, 12 allows the top end flap 32 to be coated with adhesive and adhesively attached to the bottom end flap 12 so that the open end of the carton 3 maintains structural stability after removal of the dispenser panel 72. The top end flap 32 may be otherwise shaped without departing from the scope of this invention.

In the illustrated embodiment and as best understood with reference to FIG. 1, the angle A1 is approximately 20 degrees, the angle A2 is approximately 15 degrees, and the third portion 96 of the tear line 74 has a length L4 of approximately 3½ inches (89 mm). In the illustrated embodiment the end panel 32 is sized to extend substantially between the top panel 30 and the bottom panel 10 at the closed end 53 of the carton 3. The end panel 32 could be otherwise shaped (e.g., to only partially close the end 53 of the carton 3) without departing from the invention.

In the illustrated embodiment, the portions 102, 104 of the tear line 74 in the end flap 32 are generally orthogonal and form a generally L-shaped retaining portion 110 (FIG. 7) of the carton upon removal of the dispenser panel 72. In one embodiment the fifth portion 102 of the tear line extends in the lateral direction from the fold line 62 a distance D1 (FIG. 1) across the end flap 32. In the illustrated embodiment, the sixth portion of the tear line 74 extends in the longitudinal direction from the fifth portion 102 a distance D2 (FIG. 1) across the end flap 32. In one embodiment the distance D1 is in the range of at least approximately 10% to approximately 90% of the height H1 of the end flap 32 and the distance D2 is in the range of approximately 10% to approximately 90% of the width W1 of the end flap 32. In the illustrated embodiment, the distance D1 is approximately 2.5 inches (63.5 mm), the distance D2 is approximately 2.5 inches (63.5 mm), the height H1 is approximately 5.0 inches (127 mm), and the width W1 is approximately 5.0 inches (127 mm).

In one embodiment, the seventh portion 105 of the tear line 74 intersects the fold line 62 at a location spaced apart from the fold line 41 a distance D3 (FIG. 1) in the range of at least approximately 10% to approximately 90% of the width W2 of the side panel 40. In the illustrated embodiment, the distance D3 is approximately 2.5 inches (63.5 mm) and the width W2 is approximately 5.0 (127 mm). It is understood that the dimensional information presented herein may vary and is not intended to limit the scope of the invention.

In the illustrated embodiment and as best understood with reference to FIG. 1, the portions of the tear line 74 includes various different types of lines of weakening that form the removable dispenser panel 72. For example, the first portion 84, the second portion 86, the sixth portion 104, and eight portion 106 include a series of offset cuts or slits separated by nicks. When the dispenser panel 72 is removed, the offset cuts or slits and nicks of the tear line 74 form a rough edge comprising a series of generally rectangular protrusions and rectangular recesses between adjacent protrusions. The third portion 96, the fourth portion 98, part of the fifth portion 102 adjacent the fold line 62, and part of the seventh portion 105 adjacent fold line 62 include a series of slits or cuts separated by generally v-shaped nicks formed between the slits or cuts. In the illustrated embodiment, the slits or cuts have a straight portion and an angled end portion that forms the generally v-shaped nicks between adjacent slits or cuts. When the dispenser panel 72 is removed, the slits or cuts separated by generally v-shaped nicks form a rough edge comprising either generally v-shaped protrusions or generally v-shaped recesses on the respective edges of the carton 3 and the respective edges of the dispenser panel. The rounded corner 88, a portion of the seventh portion 105 adjacent the fold line 41, and the corner at the intersection of the fifth portion 102 and sixth portion 104 are formed by aligned cuts or slits separated by nicks that are substantially aligned with the cuts or slits. In one embodiment, the aligned cuts or slits are generally longer than the cuts or slits forming the other types of lines of weakening for the other portions of the tear line 74. When the dispenser panel 72 is removed, the aligned cuts or slits and nicks form a generally smooth edge (e.g., having little or no carton material protruding from an edge or little or no recessed portion formed in an edge). The various portions of the tear lines 74 could be formed by other types of lines of weakening including the types illustrated herein or other types that are not illustrated herein. Also, the types of lines of weakening illustrated herein could be interchanged so that any of the type of lines of weakening illustrated herein could be used on any or all of the portions of the tear line without departing from the invention.

As shown in FIG. 1, portions of the fold lines 31, 41, 62, and 64 are formed by aligned cuts or slits formed along the depressed area of carton material that forms the fold line. The cuts or slits are separated by nicks of material in the depressed portion of material forming the fold line. In the illustrated embodiment, the portion of the longitudinal fold line 31 between the lateral fold line 64 and the third portion 96 of the tear line 74 is formed by cuts or slits in the depressed area of the carton material forming the fold line. The portion of the longitudinal fold line 41 between the lateral fold line 64 and the intersection of the second portion 86 of the tear line 74 is formed by cuts or slits in the depressed area of the carton material forming the fold line. The respective portions of the lateral fold line 64 that respectively foldably attaches the side end flaps 24, 44 and side panels 20, 40 are formed in a manner that includes cuts or slits in the depressed area of the carton material forming the fold line. The respective portions of the lateral fold line 62 that respectively foldably attaches the side end flaps 22, 42 and side panels 20, 40 are formed in a manner that includes cuts or slits in the depressed area of the carton material forming the fold line. Any, all, or none of the fold lines could be formed in a manner including cuts or slits in the depressed area of the carton material forming the fold line or the fold lines may be formed by other methods without departing from this invention.

The present invention can be used in cartons that include various features, including additional opening features that provide easy access to the articles, and tilt features that position the articles at the front or rear end of the carton.

The blank according to any of the embodiments of the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

The term "line" as used herein includes not only straight lines, but also other types of lines such as curved, curvilinear or angularly displaced lines.

The above embodiments are described as having one or more panels adhered together by glue. The term "glue" is intended to encompass all manner of adhesives commonly used to secure carton panels in place.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for containing a plurality of articles, the carton comprising:

a plurality of panels that extend at least partially around an interior of the carton, the plurality of panels including a top panel, a bottom panel, a first side panel, and a second side panel; the top panel connected to the first side panel along a first fold line; the top panel connected to the second side panel along a second fold line;

at least two end flaps respectively foldably attached to respective panels of the plurality of panels, wherein the end flaps are overlapped with respect to one another and thereby at least partially close a first end of the carton; the at least two end flaps including a first top end flap connected to the top panel along a third fold line; and a dispenser panel that is at least partially defined by a tear line and an access flap, the access flap disposed in the top panel for initiating removal of the dispenser panel, the tear line comprising a first oblique portion extending from the access flap across the top panel, the tear line then extending across the first fold line into the first side panel, a second oblique portion extending from the access flap across the top panel to the second fold line, a third portion extending along the second fold line, and a fourth oblique portion extending in the top panel from the third portion to the third fold line, the tear line then extending across the third fold line into the first top end flap.

2. The carton of claim 1 wherein the first oblique portion intersects the first fold line at a first angle and the second oblique portion intersects the second fold line at a second angle.

3. The carton of claim 2 wherein the first angle is greater than the second angle.

4. The carton of claim 1 wherein the dispenser panel comprises at least a portion of the first side panel.

5. The carton of claim 1 wherein the at least two end flaps include side end flaps respectively foldably attached to the side end panels.

6. The carton of claim 5 wherein the dispenser panel comprises at least a portion of at least one of the side end flaps.

7. The carton of claim 1 wherein the tear line forms a generally L-shaped retaining portion at the first end of the carton.

8. The carton of claim 7 wherein the L-shaped retaining portion is in the top end flap.

9. The carton of claim 1 wherein the tear line extends to an end of the first top end flap.

10. The carton of claim 1 wherein a fifth portion of the tear line extends in an oblique direction in the first side panel.

11. The carton of claim 10 wherein a first side panel end flap is attached to the first side panel alone a fourth fold line and wherein the tear line extends from the fifth portion across the fourth fold line into the first side panel end flap.

12. The carton of claim 1 in combination with a plurality of articles, the plurality of articles comprising containers that are arranged in at least two rows in the carton.

13. A blank for forming a carton comprising:

a plurality of panels, the plurality of panels comprises a top panel, a bottom panel, a first side panel, and a second side panel; the top panel connected to the first side panel along a first fold line; the top panel connected to the second side panel along a second fold line;

at least two end flaps respectively foldably attached to respective panels of the plurality of panels; the at least two end flaps including a first top end flag connected to the top panel along a third fold line;

a dispenser panel that is at least partially defined by a tear line and an access flap, the access flap disposed in the top panel;

the tear line comprises a first oblique portion extending from the access flap across the top panel, the tear line then extending across the first fold line into the first side panel, a second oblique portion extending from the access flap across the top panel to the second fold line, a third portion extending along the second fold line, and a fourth oblique portion extending in the top panel from the third portion to the third fold line, the tear line then extending across the third fold line into the first top end flap.

14. The blank of claim 13 wherein the first oblique portion the first fold line at a first angle and the second oblique portion intersects the second fold line at a second angle.

15. The blank of claim 14 wherein the first angle is greater than the second angle.

16. The blank of claim 13 wherein the dispenser panel comprises at least a portion of the first side panel.

17. The blank of claim 13 wherein the at least two end flaps include side end flaps respectively foldably attached to the side end panels.

18. The blank of claim 17 wherein the dispenser panel comprises at least a portion of at least one of the side end flaps.

19. The blank of claim 13 wherein the tear line extends to an end of the first top end flap.

20. The carton of claim 13 wherein a fifth portion of the tear line extends in an oblique direction in the first side panel.

21. The carton of claim 20 wherein a first side panel end flap is attached to the first side panel along a fourth fold line and wherein the tear line extends from the fifth portion across the fourth fold line into the first side panel end flap.

22. A method of opening a carton comprising:

providing a carton having a plurality of panels that extend at least partially around an interior of the carton, the plurality of panels including a top panel, a bottom panel, a first side panel, a second side panel, and end flaps respectively foldably attached to respective panels of the plurality of panels, the top panel connected to the first side panel along a first fold line; the top panel connected to the second side panel along a second fold line; wherein the end flaps are overlapped with respect to one another and thereby at least partially form a closed end of the carton, the end flaps including a first top end flap connected to the top panel along a third fold line; a dispenser panel at least partially defined by a tear line and including an access flap in the top panel, the tear line comprising a first oblique portion extending from the access flap across the top panel, the tear line then extending across the first fold line into the first side panel, a second oblique portion extending from the access flap across the top panel to the second fold line, a third portion extending along the second fold line, and a fourth oblique portion extending in the top panel from the third portion to the third fold line, the tear line then extending across the third fold line into the first top end flap;

folding the access flap to allow access to the dispenser panel;

grasping the dispenser panel and at least partially separating the dispenser panel from the carton by at least partially tearing the carton along the first and second oblique portions, third portion, and fourth oblique portion to create a dispenser opening in the carton.

23. The method of claim 22 further comprising removing a container from the carton through the dispenser opening.

24. The method of claim 22 wherein at least partially separating the dispenser panel from the carton comprises at least partially tearing the carton along the fourth oblique portion.

25. The method of claim 22 wherein a fifth portion of the tear line extends in an oblique direction in the first side panel, and at least partially separating the dispenser panel from the carton comprises at least partially tearing the carton along the fifth portion.

26. The method of claim 22 wherein the tear line includes two orthogonal portions in the first top end flap, and wherein at least partially separating the dispenser panel from the carton comprises at least partially tearing the carton along the two orthogonal portions.

27. The method of claim 22 wherein the at least partially separating the dispenser panel comprises pulling the dispenser panel in a first direction and then pulling the dispenser panel in a second direction.

28. The method of claim 27 wherein the first direction is generally parallel to a longitudinal axis of the carton.

29. The method of claim 28 wherein the second direction is generally oblique relative to the first direction.

* * * * *